United States Patent [19]

Dressel

[11] 4,271,914

[45] Jun. 9, 1981

[54] AUTOMATIC FEED AND ROTATIONAL SPEED CONTROL SYSTEM OF A HYDRAULIC MOTOR OPERATED DRILL

[75] Inventor: Michael O. Dressel, Englewood, Colo.

[73] Assignee: The United States of America as represented by the Secretary of the Interior, Washington, D.C.

[21] Appl. No.: 968,046

[22] Filed: Dec. 8, 1978

Related U.S. Application Data

[63] Continuation-in-part of Ser. No. 746,767, Dec. 2, 1976, abandoned.

[51] Int. Cl.[3] ..... E21B 3/00; E21C 5/00

[52] U.S. Cl. ..... 173/158; 173/8; 60/719

[58] Field of Search ..... 173/4, 8, 9, 11, 157, 173/158; 91/170 R, 189 R, 31, 178; 60/719

[56] References Cited

U.S. PATENT DOCUMENTS

| | | | |
|---|---|---|---|
| 1,761,310 | 6/1930 | Osgood | 173/11 |
| 2,320,874 | 6/1943 | Lehmann | 173/4 |
| 2,594,098 | 4/1952 | Vanderzee | 173/158 X |
| 2,693,084 | 11/1954 | Badger | 173/4 X |
| 2,804,751 | 9/1957 | Schroeder | 173/8 |
| 3,189,103 | 6/1965 | Attebo et al. | 173/11 X |
| 3,385,376 | 5/1968 | Hobhouse | 173/8 |
| 3,593,807 | 7/1971 | Klima | 176/6 |
| 3,802,514 | 4/1974 | Gin et al. | 173/8 |
| 3,823,784 | 7/1974 | Feucht | 173/11 |
| 4,064,950 | 12/1977 | Salmi et al. | 173/9 X |

OTHER PUBLICATIONS

*Fluid Controls, Inc. Catalog,* Mentor, Ohio, Dec. 1974, pp. 9.01–9.04.

*Primary Examiner*—Robert Mackey
*Attorney, Agent, or Firm*—Gersten Sadowsky; Donald A. Gardiner

[57] ABSTRACT

A needle valve placed in series with the hydraulic drill feed motor, and responsive to fluid flow in the hydrualic system subject to the operation of a pressure relief valve therein, causes the thrust to increase and the feed rate to decrease as the drill enters a difficult drilling material, a proportional flow divider interposed between the pressurized hydraulic fluid source and the hydraulic drill rotation motor and the hydraulic feed motor splits the flow and maintains a fixed proportion between the flows to the two motors to cause the rotational motor to slow down as the feed motor slows down. A pressure compensated flow control valve bypassing the proportional flow divider to the drill rotation motor insures a fixed amount of fluid flow to the rotational motor regardless of the difficulty of material being drilled to maintain a minimal rotational speed of the drill rotation motor.

2 Claims, 1 Drawing Figure

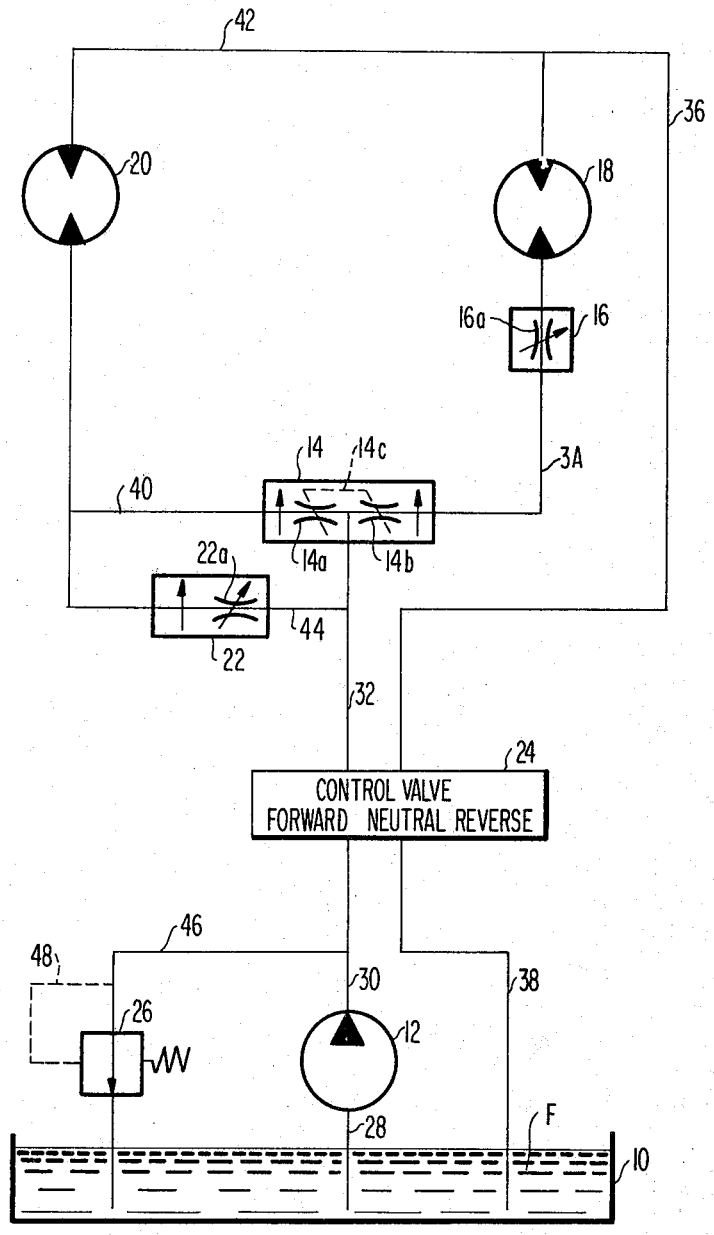
42
36
20
18
16a
16
14
14c
3A
40
14a
14b
22a
44
22
32
24
CONTROL VALVE
FORWARD NEUTRAL REVERSE
46
48
30
38
26
12
28
F
10

AUTOMATIC FEED AND ROTATIONAL SPEED CONTROL SYSTEM OF A HYDRAULIC MOTOR OPERATED DRILL

CROSS REFERENCE TO RELATED APPLICATION

This application is a continuation-in-part of prior application Ser. No. 746,767, filed on Dec. 2, 1976, and now abandoned.

BACKGROUND OF THE INVENTION

FIELD OF THE INVENTION

This invention relates to hydraulically operated drills for drilling rock material and the like, and more particularly to a system for automatically controlling the feed and rotational speed of the drill as a function of the drillability of the material being drilled.

Drills employed in the drilling of rock material and other earth formations encounter rock or earth strata of varying drillability. Where the drill is provided with a constant thrust force moving the drill axially into the material being drilled or insuring drill feed at a constant speed, there inherently results a short life for the drill bits when the drill bits encounter relatively difficult drilling material.

It has been proposed to optimize the drilling production rate or feed speed relative to bit wear for a drill which encounters a wide variation of materials with different drilling characteristics. Attempts have been made, therefore, to automatically control the feed rate into a material and the rotational speed of the drill as a function of the drillability of material being drilled. Patents representative of such attempts are U.S. Pat. No. 3,385,376 to Hobhouse issuing May 28, 1976, and U.S. Pat. No. 3,593,807 to Klima issuing July 20, 1971.

In the Hobhouse patent, the system is characterized by a hydraulic motor for rotating the drill, a hydraulic feed motor for controlling the feed of the drill relative to the material being drilled, and a hydraulic motor for driving a drill fluid supply pump supplying fluid or lubricant to the drill. The motors are interconnected so that in operation the feed of pressure fluid to operate the feed motor and the motor driving the drilling fluid supply pump are under control of sequence valves, which sequence valves are operated by the pressure existing in the feed of the pressure fluid to the drill motor, to thereby control the feed of the drill and supply drilling fluid to the drill dependent upon the resistance to rotation of the drill.

In the patent to Klima, an electrical motor is employed for rotating the drill bit, while a hydraulic feed motor feeds the rotating drill bit relative to the rock formation or other formation being drilled. The invention is characterized by a control system for the drilling equipment which controls the downward force exerted upon the drill bit in accordance with a signal derived from the torque required to rotate the drill at a constant speed and a signal proportional to a desired drill rate. Further, a hydraulic control valve is provided responsive to the signal from the comparator to increase or decrease the flow of hydraulic fluid to the hydraulic drill feed motor and to thereby increase or decrease the downward force acting on the drill bit in accordance with the sense of the resultant signal determined in the comparator.

Both systems are, therefore, characterized by a control in which the thrust of the feed motor is increased and the feed rate decreased as the drill enters material more difficult to drill, such that the feed rate and the rotational speed of the drill are in accordance with the drillability of material being drilled.

The present invention is, therefore, directed to an improvement in a control system for controlling the feed rate and rotational speed of a drill in accordance with the drillability of material being drilled, to insure operation of the drill rotation motor at a minimum rotational speed and to insure a proportional reduction in speed of the rotation motor in response to a decrease in speed of the feed motor in an automatic manner upon the drill bit contacting rock material or other work piece whose drillability is of increasing difficulty.

SUMMARY OF THE INVENTION

The present invention is, therefore, directed to an improvement in a hydraulic control system for a hydraulically driven drill for drilling of rock material and the like which system includes a source of hydraulic pressure fluid, a first hydraulic motor for rotating the drill and a second hydraulic motor for feeding the drill to the rock material. Feed line means interconnects the source and the motors, and first means are provided within the feed line means between the source and the second motor to cause the thrust exerted by the second motor on the drill to increase and the rotational speed of the first motor to decrease as the drill enters more difficult material, and vice versa.

The improvement comprises second means within the feed lines means for delivering hydraulic fluid in a fixed proportion to the first and second motors to cause the rotational speed of the first motor to slow down in proportion to slowing down in the speed of the second motor, and vice versa.

Further, the improvement comprises third means within the feed line means for bypassing the connection between the source and the first hydraulic motor, around the second means, to deliver a fixed amount of hydraulic pressure flow to the first hydraulic motor to insure a minimum rotational speed regardless of the difficulty of drillability of the material being drilled.

BRIEF DESCRIPTION OF THE DRAWING

The single FIGURE is a schematic block diagram of the improved hydraulic control system of the present invention for a hydraulic motor driven rock drill or the like.

DESCRIPTION OF THE PREFERRED EMBODIMENT

The automatic control system for the hydraulic drilling apparatus, particularly useful in the drilling of rock material or other earth formation, as illustrated in the schematic diagram of the single FIGURE, comprises, in terms of its principal components, a sump tank 10 for holding a mass of hydraulic fluid such as oil as at F, a pump 12 for supplying the hydraulic fluid under pressure to the drill feed motor 18 through a needle valve 16 and a proportional flow divider 14, while further supplying pressure hydraulic fluid to the drill rotation motor 20, a pressure compensated flow control valve 22 which bypasses the proportional flow divider 14 relative to the drill rotation motor 20, a pressure relief valve 26 associated with the sump tank 10, and a control valve 24 for controlling the direction of flow of hydraulic fluid and, therefore, the state of drill feed and drill bit rotation, that is, either in the forward, neutral, or reverse mode.

As may be seen, a suction line 28 leads from the bottom of the sump tank 10 to the inlet side of the hydraulic pump 12, the pump discharging hydraulic fluid such as oil F under relatively high pressure through discharge line 30. It should be stated that the hydraulic pump 12, the control valve 24, the proportional flow divider 14, the needle valve 16, the drill feed motor 18, the drill rotation motor 20, the pressure compensated flow control valve 22, and the pressure relief valve 26, are conventional elements which are readily commercially available. Applicant's invention is the incorporation of these elements within a specific control system to perform specific automatic control functions with respect to the drill feed motor 18 and the drill rotation motor 20 related to the drillability of the material being drilled such as rock material whose strata has varying drillability characteristics.

The outlet line 30 from the pump 12 extends to the control valve 24, while line 32 connects the control valve 24 to the proportional flow divider 14. The proportional flow divider 14 is an important aspect of the present invention, as it supplies hydraulic fluid under pressure through line 34 to the drill feed motor 18 by way of needle valve 16 which is in series with the drill feed motor 18 and also via line 40 to the drill rotation motor 20, the proportional flow divider 14 fixing the proportion of flow between the two motors. A common link 14*c* controls simultaneously variable size restrictors 14*a* and 14*b* leading to lines 40 and 34, respectively. The proportional flow divider, therefore, causes the drill rotation motor 20 to slow down as the drill feed motor 18 slows down, upon encountering rock material of increasingly difficult drillability. In effect, the fluid flow, which responds to the operation of the control system for regulation of its rate, is proportioned by the flow divider to cause rotation of the motors to slow down as explained. This flow divider is a conventional commercially available component of which an example is a manufacture of Fluid Controls, Inc., of Mentor, Ohio, as appears with detailed descriptions of such a component in this company's catalog (revised December 1974), page 9.01, where such dividers are disclosed as operating to divide fluid flow in connections between a pump and actuators, or made for that operation at other special flow ratios. Detailed discussions of the structure and operation of proportional flow dividers are also available in the 76–77 *Fluid Power Handbook And Directory,* by the editors of *Hydraulic And Pneumatics,* pages A/147 and A/148. The presence of the needle valve 16 within line 34 leading from the proportional flow divider to the drill feed motor which may be preadjusted in terms of its orifice size at 16*a,* causes the thrust to increase and the feed rate to decrease as the drill enters the more difficult material to drill. In effect, increased load thus applied to motor 18 increases the pressure drop across this motor, and needle valve 16 in series therewith is similarly affected. Consequently, the pressure drops across motor 18 and valve 16 in combination become greater than the pressure drop across motor 20, and as resistance to drilling increases, the resultant system pressure increase occurs until relief valve 26 starts to open. Flow from source 12 is thereupon diverted through valve 26 and less flow is available to flow divider 14. As a result, less flow is delivered to rotation motor 20 and feed motor 18. Also, there is less flow going through needle valve 16, and, accordingly, as is characteristic of the operation of such a needle valve and the orifice thereof, as flow therethrough decreases a decrease in pressure through the valve will be seen at its orifice. This needle valve is a conventional commercially available component of which an example is also a manufacture of Fluid Controls, Inc., as appears with detailed descriptions of such a component in this company's catalog cited above, pages 7.01 and 7.02. This restrictive style needle valve is shown with a tapered needle which provides a variable orifice as it is screwed into or out of a mating hole, and described as having hydraulic oil channeled through the opening between the needle and hole. Theory, structure, and operational data for this well known valving operation may be found set out in yet further detail by reference to the handbook and directory cited above, pages A/142, A/143, and A/144. Now, considering the series connection between needle valve 16 and feed motor 18, and the aforesaid decreased flow thereto from flow divider 14, it follows that the aforementioned decreased pressure through the valve due to a decrease in fluid flow therethrough, provides for a greater pressure in the fluid flow to feed motor 18. With increased drill thrust thus following from the increased pressure at feed motor 18, it will be recognized that increased resistance to drilling gives rise to increased drill thrust while feed rate and, as previously noted, the rotation speed of motor 18 decreases. In turn, the proportional flow divider also causes the rotational motor 20 to slow down as the feed motor 18 slows down. The hydraulic fluid is returned from the drill feed motor through line 36 to the control valve 24 and from the control valve 24 to the sump by return line 38. Further, line 42 which joins return line 36 permits the return of hydraulic fluid from the drill rotation motor 20 to the sump tank 10. Conversely, when relatively less difficult drillability material is thereafter encountered, and resistance to drilling thus decreases, the system pressure, reflecting a return towards normalization of the load on motor 18, is relieved, and relief valve 26 returns to its normally closed setting, as is conventional in the operation of such valves. As a result, flow through needle valve 16 increases to normal since diversion of fluid through line 46 in interrupted, and flow through lines 32, 34, and 36, and the components therein normalize at an increased level, and as a consequence the pressure drop at the needle valve increases to normal. Concomitantly therewith the pressure drop at motor 18 is decreased toward normal, or that required for drill feed in material of relatively less difficult drillability.

The present invention is further highlighted by the incorporation of the pressure compensated flow control valve 22 which is mounted within bypass line 44. This line 44 in bypassing the proportional flow divider connects the pump 12 to act as the source of pressurized hydraulic fluid to the drill rotation motor 20. Valve 22 incorporates a pressure responsive, adjustably sized orifice 22*a* which decreases in size in proportion to pressure increase in line 44, upstream of valve 22. This pressure compensated control valve is a conventional commercially available component of which an example is also a manufacture of Fluid Controls, Inc., as appears with detailed descriptions of such a component in this company's catalog cited above, page 8.03. Theory, structure, and operational data for this well known valving operation may be found set out in yet further detail by reference to the handbook and directory cited above, page A/144 through page A/147. Thus, regardless of the effect of the proportional flow divider 14 in dividing the flow through lines 40 and 34 and feeding the drill feed motor 18 and the drill rotation motor 20 in proportion, the pressure compensated flow control valve 22 functions to insure a fixed quantity of hydraulic fluid is flowing through the drill rotation motor to set a minimum rotational speed when the drill is in the material being drilled, this causing a decreasing chip size as the drill enters the more difficult material to drill and having a positive effect on increasing the life of the drill bit.

As may be seen, the bypass line 44 connects to line 32 at a point intermediate of the control valve 24 and the proportional flow divider 14 and to line 40 upstream of the drill rotation motor 20. Line 42 returns both flows, that is, lines 40 and 44 from the drill rotation motor 20 to the sump tank 10 via the common return 36 for both the drill feed motor 18 and the drill rotation motor 20.

The system is provided with a pressure relief valve 26 which is set at a pressure level higher than that normally encountered during operation of the drilling apparatus, comprising the drill rotation motor and the drill feed motor, so as to open at the higher system pressure encountered when drilling material more difficult to drill. Line 46 joins discharge line 30 for the pump, upstream of the control valve 24, and by way of tap line 48 the pressure relief valve 26 senses the pressure within line 46 and thus at the discharge of the pump 12 to permit the pressure relief valve 26 to open and return the pressure hydraulic fluid to the sump tank 10, should the system at control valve 24 or downstream therefrom become subject to the higher pressure therein or otherwise blocked.

From the above, it is evident that the hydraulic control system of the present invention greatly increases the bit wear life when material of widely varying drillability properties is being drilled. The thrust and rotational speed of the rotary drill in a given strata of rock for example, will determine the amount of wear on the drill bit and the production rate available. The hydraulic control system of the present invention automatically varies the thrust and rotational speed as the drill enters different materials providing the correct drilling conditions for minimum wear to occur on the drill bit. The hydraulic control system increases the thrust as the drill enters material difficult to drill and decreases the rotational speed of the drill rotation motor, meanwhile maintaining a fixed proportion between the flow passing to the drill feed motor and that passing to the drill rotation motor. Further, by way of the pressure compensated flow control valve, a minimum flow rate of hydraulic fluid exists from the source or pump 12 to the drill rotation motor 20, under difficult drillability material constituting a given strata of the rock being drilled. Further, the increased thrust causes the drill to more easily break through the harder rock, and the decreased rotational speed of the drill prevents overheating of the drill bit which would otherwise reduce its strength and cause excessive wear.

It is further obvious that the control system of the present invention is characterized by the use of the proportional flow divider to proportion the flow between the drill feed motor 18 and the drill rotation motor 20 to slow the rotation motor 20 down in response to a decrease in the speed of the feed motor, while maintaining a minimum rotational speed of the drill rotation motor 20 through the pressure compensated flow control valve 22 within bypass line 44.

While the invention has been particularly shown and described with reference to a preferred embodiment thereof, it will be understood by those skilled in the art that various changes in form and details may be made therein without departing from the spirit and scope of the invention.

What I claim is:

1. In a hydraulic system for a hydraulically driven drill for drilling in rock material, said system comprising a source of hydraulic pressure fluid including a sump tank of hydraulic fluid and a hydraulic pump, a first hydraulic motor for rotating said drill, a second hydraulic motor for feeding said drill relative to said material being drilled, fluid flow lines means interconnecting said source and said motors, said system further comprising:

first means within said line means and between said source and said second motor for causing thrust exerted by the second motor on said drill to increase and rotational speed of the first motor to decrease as the drill encounters more difficult drillability material and vice versa, said first means including a needle valve in series with said second motor;

second means within said line means in series with said needle valve for delivering hydraulic fluid under fixed proportional flow to said motors to cause the rotational speed of the first motor to slow down in proportion to the slowing down in the speed of the second motor;

a relief valve in parallel with said pump by connections to said line means between said pump and said second means and to said tank, and third means within said line means for connecting said source to said first motor and bypassing said second means for delivering hydraulic fluid at a fixed rate to said first motor when an increasing load is applied to said second motor as drilling meets with a higher degree of resistance to drilling to set a minimum rotational speed of said first motor;

whereby said increasing load applied to said second motor further results in an increased pressure drop across the combination of said second motor and said needle valve as increased load on said second motor exceeds pressure drop across said first motor, and in an increased pressure in said lines means ultimately opening said relief valve wherefore fluid diverted therethrough lessens flow to said second means to thereby lessen flow to said motors and needle valve with the consequence that drill rotation is reduced and decreased pressure at said needle valve increases pressure at said second motor with greater thrust made available therefrom, and a decreasing load applied to said second motor as drilling meets with a resistance decreasing from said higher degree thereof results in a decreased pressure in said line means which ultimately obtains closing said relief valve which effectuates increased flow in said line means with increasing flow to said second means and thereby enabling increased pressure at said needle valve with concomitantly decreasing pressure drop at said second motor resulting in reducing the thrust thereof to accommodate said decreased resistance to drilling.

2. The hydraulic control system as claimed in claim 1, wherein said third means comprises a pressure compensated flow control valve whose flow rate is constant regardless of line pressure variation within said line means leading from the source to said second means.

* * * * *